United States Patent [19]

Blum

[11] Patent Number: 4,573,726

[45] Date of Patent: Mar. 4, 1986

[54] HOISTING APPARATUS FOR ELECTRIC SUBMERSIBLE PUMP UNITS

[76] Inventor: Albert Blum, Scheiderhöhe, 5204 Lohmar 1, Fed. Rep. of Germany

[21] Appl. No.: 596,946

[22] Filed: Apr. 5, 1984

[30] Foreign Application Priority Data

Apr. 19, 1983 [DE] Fed. Rep. of Germany ..... 3314051

[51] Int. Cl.[4] ..... B66C 23/60

[52] U.S. Cl. ..... 294/86.33; 294/82.11; 294/82.24

[58] Field of Search ..... 294/86.33, 86.3, 86.31, 294/83 R, 82 R, 78 R, 110 R, 111, 112, 110 B, 89, 90, 91, 116

[56] References Cited

U.S. PATENT DOCUMENTS 3,741,525 6/1973 Smedley ..... 294/78 R 4,258,888 3/1981 Sawn ..... 294/83 R

*Primary Examiner*—James B. Marbet

*Attorney, Agent, or Firm*—Reising, Ethington, Barnard, Perry & Milton

[57] ABSTRACT

A hoisting apparatus for submersible pump units (4), which is provided particularly for use in deep shafts, comprises a flexible traction element, a drive means for hoisting and lowering the traction element, and a coupling part (1) arranged at the lower end of the traction element, which is automatically connectable to and releasable from a corresponding connecting element (26) provided on the submersible pump unit. In order to ensure that the coupling part (1) can be attached easily and automatically to the connecting element (26) provided on the submersible pump unit and can be released again therefrom with equal ease, and particularly can be guided accurately down to the connecting element without major outlay, the coupling part (1) arranged on the traction element exhibits an eye (2) which encloses with play the electric cable (5) passed down to the electric motor (3) of the submersible pump unit (4), while the connecting element (26) provided on the submersible pump unit is arranged in immediate proximity to the electric cable (5).

12 Claims, 5 Drawing Figures

Fig.1
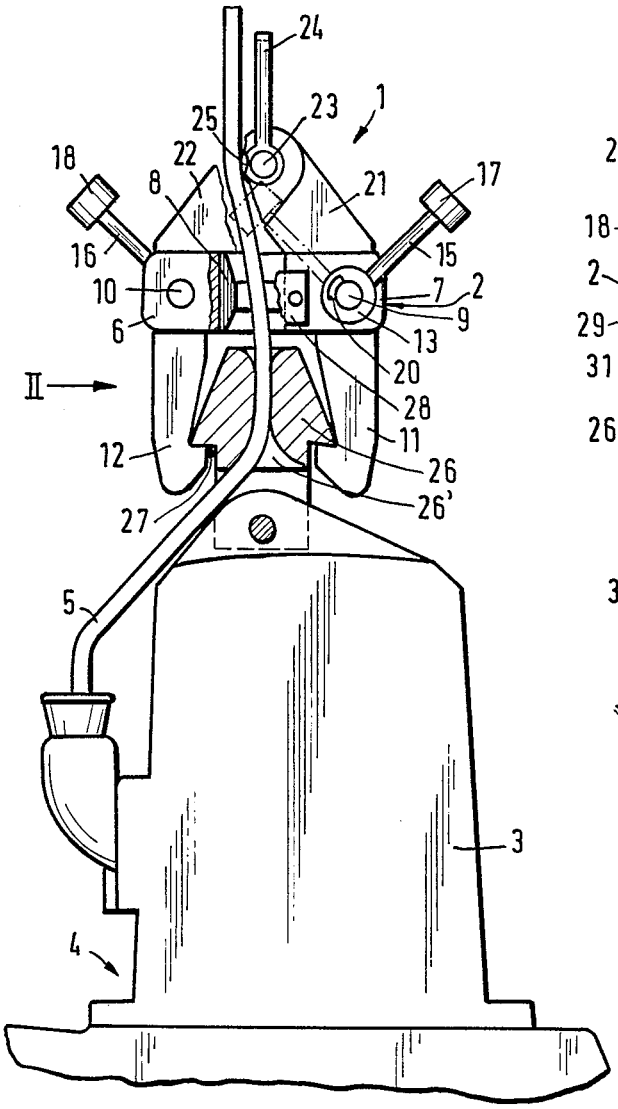
Fig.2
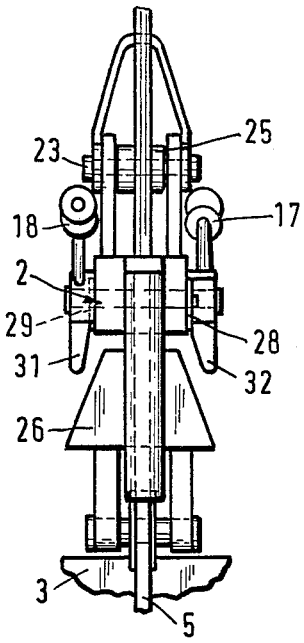
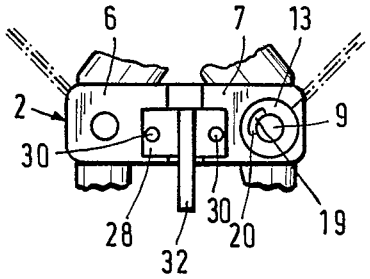
Fig.3

Fig.4
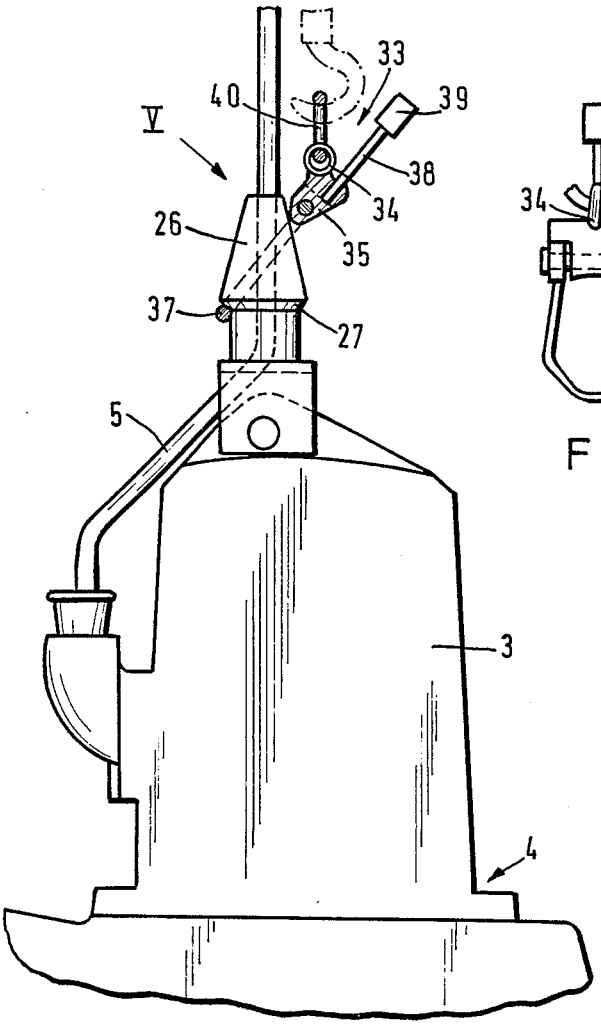
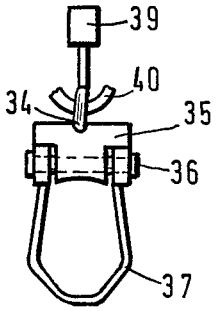
Fig.5

HOISTING APPARATUS FOR ELECTRIC SUBMERSIBLE PUMP UNITS

The invention relates to a hoisting apparatus for electric submersible pump units, particularly for use in deep shafts, comprising a flexible traction element, a drive means for hoisting and lowering the traction element and a coupling part arranged at the lower end of the traction element, which is automatically connectable to and releasable from a corresponding connecting element provided on the submersible pump unit.

Long chains or wire cables, which are firmly connected to the submersible pump units, are used for hoisting and lowering the latter. When the submersible pump unit has been lowered, the chain or the wire cable is secured to the top edge of the shaft and remains permanently connected to the submersible pump unit. In order to hoist the submersible pump unit out of the shaft, the chain is attached to a hoisting appliance and then hauled out of the shaft conjointly with the submersible pump unit. The permanently arranged long chains or wire cables represent a substantial cost factor of the one hand, because each submersible pump unit has to be connected to a chain or a wire cable, and on the other hand the chains or wire cables are heavy to handle. Generally, only hoisting appliances with a stroke of up to 3 m are available, so that when hauling submersible pump units up out of deep shafts frequent transposition is necessary. Furthermore the customary steel chains or wire cables which are normally used for submersible pumps are sensitive to corrosion.

A hoisting apparatus of the type initially defined is known from German Offenlegungsschrift No. 2,849,887, wherein after the submersible pump unit has been lowered into a shaft the traction element is releasable therefrom and is automatically couplable to the submersible pump unit in order to haul the latter up. Such a hoisting apparatus, which does not need to remain connected to the submersible pump unit, can in fact be used to operate a plurality of submersible pump units; however, a substantial outlay is necessary to guide the coupling part of the hoisting apparatus accurately down to the submersible pump unit. Separate tubular guides must be provided to guide the coupling part.

The underlying aim of the invention is to develop a hoisting apparatus, the coupling part of which can be attached easily and automatically to the connecting element provided on the submersible pump unit and can be released again therefrom with equal ease, and which can be guided deliberately down to the connecting element without major outlay.

This aim is achieved according to the invention when the coupling part arranged on the traction element exhibits an eye which encloses with play the electric cable passed down to the electric motor of the submersible pump unit, and that the connecting element provided on the submersible pump unit is arranged in immediate proximity to the electric cable.

No separate guide means is necessary in the case of the hoisting apparatus according to the invention, because the electric cable leading down to the submersible pump unit, which is present in any case, is used to guide the coupling part. Because the connecting element is arranged on the submersible pump housing in immediate proximity to the electric cable, the coupling part present on the traction element is guided automatically to the connecting element and can be coupled automatically thereto in various ways.

Preferably, the connecting element provided on the submersible pump unit encloses the electric cable and exhibits an all-round undercut at its outer edge. An easy and deliberate coupling and release is possible by this means.

In this case the connecting element provided on the submersible pump unit may be of mushroom-shaped construction and exhibit a central passage orifice for the electric cable. Furthermore, the connecting element may be bevelled frustoconically at its upper side, whereby the engaging mechanism is further improved.

The coupling part provided on the traction element may exhibit a supporting part with a central orifice as an eye for the passage of the electric cable, at least two coupling hooks, which engage behind the undercut provided on the connecting element, being articulated to the supporting part.

In order to facilitate the engagement and release of the coupling hooks, the latter may be selectively pretensionable into the open position or into the closed position. The pretension in this case may be applied in a very simple manner by adjustable counterweights.

Alternatively, the coupling part provided on the traction element may also be constructed as a closed stirrup which encloses the electric cable and is engageable on one side behind the undercut of the connecting part provided on the submersible pump unit.

This stirrup also may be provided with an adjustable counterweight by which it is pretensionable into a coupled position and an open position.

In all the embodiments, the connecting element provided on the submersible pump unit may be provided with a traction relief means for the electric cable.

To permit the eye provided on the coupling part to be passed easily around the electric cable, it is preferably provided with a lateral closable passage for the insertion of the electric cable, so that the eye can immediately be connected to, and released again from, the electric cable.

In order to facilitate the guidance of the eye on the electric cable, the latter should be tensioned tautly upwards at least during the hoisting and lowering of the coupling part. For this purpose, a tensioning element for mounting and simultaneously pretensioning the electric cable may be provided in the region of the upper end of the shaft.

The invention is illustrated by examples in the drawing and described in detail below with reference to the drawing, wherein:

FIG. 1 shows a side elevation, shown partly cut away, of the coupling part of the hoisting apparatus according to the invention and of the electric motor of the submersible pump unit;

FIG. 2 shows a view from the direction of the arrow 2 of the coupling part according to FIG. 1;

FIG. 3 shows a partial side elevation corresponding to FIG. 1, but not shown cut away, of the coupling part illustrated in FIG. 1;

FIG. 4 shows a side elevation, shown partly cut away, of a further embodiment of the coupling part in combination with an electric motor of a submersible pump unit and FIG. 5 shows a view from the direction of the arrow 5 in FIG 4.

A coupling part, which as a whole is designated 1, comprises a supporting part 2, which encloses with play an electric cable 5 passed down to the electric motor 3 of the submersible pump unit 4. The supporting part 2 consists for this purpose of two halves 6 and 7 of U-shaped construction, which form an eye and enclose the electric cable. In order to avoid damaging the electric cable 5 during the guiding of the coupling part down to the lowered submersible pump unit 4 and during hoisting up, the insides of the members of the U-shaped halves 6 and 7, and also of their bridges, are lined with a cushion 8. A coupling hook 11 or 12 is seated in the recess between the U members on each of the axes 9 and 10 which extend through bores in the bridges of the U-shaped halves 6 and 7. Each of the axes 9 and 10 projects beyond a member of the U-shaped half 6 or 7 and carries a stop pin 20. Rings 13 and 14 are arranged on the axes 9 and 10 on opposite sides of the supporting part 2. Rods 15 and 16, on which counterweights 17 and 18 are arranged, radially from the rings. By pivoting the rods 15 and 16 supporting the counterweights from the position illustrated by solid lines in FIG. 1 into the position illustrated by chain-dotted lines, the associated coupling hooks are pretensioned through the axes 9, 10. The pivotal movement of the rods is then limited by a recess 19 in the rings 13 and 14, into which the respective stop pin 20 engages. The coupling hooks 11, 12 can be pretensioned by the counterweights into the open position or into the closed position, as will be explained more fully below.

In order to attach the supporting part 2 to a flexible traction element, the supporting part 2 is provided on the side remote from the coupling hooks 11 and 12 with two straps 21 and 22 which extend from the opposite ends of the U-shaped halves 6, 7 obliquely upwards towards the centre of the supporting part. The free ends of the straps 21 and 22 are mutually connected by a bolt 23, which carries a supporting eye 24 permitting the engagement of a hook of the flexible traction element. In order to guide the electric cable 5, extending through the supporting part 2, without friction, a roller 25 is mounted rotatably on the bolt 23 connecting the straps 21, 22.

The coupling part 1 cooperates with a connecting element 26 arranged on the submersible pump unit 4, namely at the upper end of the electric motor 3. The connecting element 26, which is provided with a central passage orifice 26', encloses the electric cable 5, so that the coupling part 1, when it slides down the electric cable 5 into a shaft not shown in the drawing to the submersible pump unit 4, is guided automatically to the connecting element 26. The connecting element 26 exhibits a mushroom-shaped configuration and is of frustoconical construction at its upward pointing end. The coupling hooks 11 and 12 can engage behind an undercut 27 constructed at the lower end of the frustoconical part of the connecting element 26, in order that the submersible pump unit can be hoisted out of the shaft and lowered into the shaft by means of a hoisting appliance, not shown, via the flexible traction element and the coupling part 1 carried thereby.

Securing webs 31 and 32, which are arranged staggered at 90° to the coupling hooks, are provided to prevent the coupling hooks 11 and 12 from slipping off the connecting element 26. The securing webs are seated on plates 28 and 29, which connect the mutually facing members of the U-shaped halves 6, 7 of the supporting part 2. The plates 28 and 29 are connected by fastening elements 30 to the associated ends of the members of the halves 6 and 7. The securing webs 31 and 32 effect a further centering of the supporting part and an aligning relative to the connecting element 26 when the coupling part 1 is guided down along the electric cable 5. After the coupling hooks 11 and 12 have engaged behind the undercut, the securing webs 31 and 32 prevent any lateral movement of the coupling part 1 relative to the connecting element 26.

Furthermore, a lateral closable passage, which permits the introduction of the electric cable 5 into the supporting part 2 in the simplest manner, is created by a releasable attachment of at least one of the plates 28 and 29.

FIGS. 4 and 5 show another embodiment of the coupling part. In this embodiment the coupling part, which as a whole is designated 33, is constructed as a closed stirrup which encloses the electric cable 5 and is engageable on one side behind the undercut 27 of the connecting element 26 of the submersible pump unit 4. The coupling part 33 comprises a supporting element 35, provided with a supporting loop 34, which as FIG. 5 shows is of approximately T-shaped configuration. A bolt 36, which extends through the beam of the T-shaped supporting element 35, serves to fasten the free ends of the stirrup 37, which forms a closed eye. A rod 38, upon which a counterweight 39 is arranged, extends from the web, supporting the supporting loop 34, of the U-shaped supporting element 35. A larger supporting ring 40 is passed through the supporting loop 34 for the attachment of a hook carried by a flexible traction element. To permit the pretension acting upon the supporting element to be modified, either the rod 38 including counterweight 39 may be removable from the supporting element, or else the counterweight may be slidable on the rod.

When it is required to lower a submersible pump unit into a deep shaft, where the exemplary embodiment illustrated in FIGS. 1 to 3 is used, one of the plates 28, 29 is removed or released on one side and the electric cable 5 leading to the motor 3 of the submersible pump unit is introduced into the slot produced between the members of the supporting part, into the supporting part. Then the released plate is reattached by means of the fastening elements. A hook attached to a flexible traction element may now be hooked into the supporting eye 24 of the coupling part 1. The coupling part is then lowered onto the connecting element 26 of the submersible pump unit, and the coupling hooks 11 and 12 are engaged behind the undercut 27 of the connecting element 26.

After the engagement of the coupling hooks 11 and 12, the counterweights are pivoted into the position shown by chain-dotted lines in FIG. 1, that is to say inwards, whilst the other end of the recess 19 contacts the stop pin 20. The counterweights therefore tension the two coupling hooks 11 and 12 into the opening direction.

The submersible pump unit may now be lowered to the required position in the shaft. When the submersible pump unit has been deposited upon the bottom of the shaft, and the coupling part 1 is lowered further, the coupling hooks pretensioned in the opening direction can disengage from the undercut, so that the coupling part 1 can be moved back upwards along the electric cable 5 by means of the flexible traction element. After this the electric cable 5 is removed out of the supporting part 2 again after releasing a plate, and the coupling part is ready for a fresh operation.

When it is required to hoist a submersible pump unit standing on the bottom of a deep shaft out of the shaft by means of the coupling part illustrated in FIGS. 1 to 3, the coupling hooks 11 and 12 of the coupling part are pretensioned in the closing direction, by pivoting both counter-weights outwards into the position illustrated by solid lines in FIG. 1. The coupling part is then guided down along the electric cable 5, by lowering the flexible traction element, into the shaft to the submersible pump unit. When the coupling hooks 11 and 12 reach the frustoconically shaped upper end of the connecting element 26 of the submersible pump unit, the free ends of the coupling hooks slide over the conical region of the connecting element and engage into the undercut after passing over the lower edge. After the engagement of the coupling hooks, the guiding and securing webs 31 and 32 secure the coupling part against slipping off laterally. When the coupling hooks have engaged firmly into the undercut, the coupling part, and the submersible pump unit connected thereto, can be hoisted out of the shaft by raising the flexible traction element.

When a submersible pump unit is to be lowered into a shaft using the embodiment of the coupling part illustrated in FIGS. 4 and 5, the stirrup 37 is released from the supporting element 35 by withdrawing the bolt 36 from the latter and is passed round the electric cable of the submersible pump unit to be lowered and reconnected to the coupling part 33 by introducing the bolt 36 into the supporting element 35. A hook of a flexible traction element is inserted into the ring 40 of the coupling part, and the stirrup 37 is engaged behind the undercut of the connecting element on the submersible pump unit. The beam of the T-shaped supporting element 35 is then braced against that side of the frustoconical upper end of the connecting element 26 opposite to the engagement of the stirrup 37.

In order to pretension the coupling part into the opening direction, the rod 38 must be pushed into the supporting element 35, so that the counterweight 39 has the tendency to disengage the stirrup 37 out of the undercut of the connecting element as soon as no further traction is exerted upon the supporting element 35.

The submersible pump unit can now be lowered into the shaft by paying out the flexible traction element. When the submersible pump unit has reached the bottom of the shaft, and the flexible traction element descends somewhat further, the counterweight 39 lifts out the stirrup 37 from the undercut, because the counterweight pivots the coupling part 33 about the ring 40 in the supporting loop 34. The flexible traction element can now be hoisted, whilst the stirrup enclosing the electric cable moves upwards along the cable.

When it is required to hoist a submersible pump unit from the bottom of a shaft, after inserting the electric cable into the stirrup 37 forming an eye and after removing the rod 38 with the counterweight 39 from the supporting element 35, the coupling part 33 is lowered along the electric cable into the shaft until the stirrup 37 slides over the conical region of the connecting element, passes over the lower edge of the latter and engages into the undercut. Because the weight of the stirrup 37 tends to pivot the coupling part 33 so that the lower part of the stirrup 37 firmly abuts the connecting element 26, the stirrup 37 cannot becomes detached from the connecting element even during hoisting, that is to say when hauling the submersible pump unit out of the shaft. The submersible pump unit can therefore be moved up safely out of the deep shaft.

I claim:

1. Hoisting apparatus for electric submersible pump units, particularly for use in deep shafts, comprising a flexible traction element, a drive means for hoisting and lowering the traction element and a coupling part arranged at the lower end of the traction element, which is automatically connectable to and releasable from a corresponding connecting element provided on the submersible pump unit, characterised in that the coupling part (1; 33) arranged on the traction element exhibits an eye (2; 37) which encloses with play the electric cable (5) passed down to the electric motor (3) of the submersible pump unit (4), and that the connecting element (26) on the submersible pump unit (4) is arranged in immediate proximity to the electric cable (5).

2. Hoisting apparatus according to claim 1, characterised in that the connecting element (26) provided on the submersible pump unit (4) encloses the electric cable (5) and exhibits an all-round undercut (27) at its outer edge.

3. Hoisting apparatus according to claim 2, characterised in that the connecting element (26) provided on the submersible pump unit (4) is of mushroom-shaped construction and exhibits a central passage orifice (26') for the electric cable (5).

4. Hoisting apparatus according to claim 3, characterised in that the connecting element (26) is bevelled frustoconically at its upper side.

5. Hoisting apparatus according to claim 2, characterised in that the coupling part (1) provided on the traction element exhibits a supporting part (2) with a central orifice as an eye for the passage of the electric cable (5), and that at least two coupling hooks (11, 12), which engage behind the undercut (27) provided on the connecting element (26) are articulated to the supporting part (2).

6. Hoisting apparatus according to claim 5, characterised in that the coupling hooks (11, 12) are selectively pretensionable into the open position or into the closed position.

7. Hoisting apparatus according to claim 6, characterised in that adjustable counterweights (17; 18) are provided on the coupling hooks (11, 12).

8. Hoisting apparatus according to claim 2, characterised in that the coupling part (33) provided on the traction element is constructed as a closed stirrup (37) which encloses the electric cable (5) and is engageable on one side behind the undercut (27) of the connecting element (26) of the submersible pump unit (4).

9. Hoisting apparatus according to claim 8, characterised in that an adjustable counterweight (39), by which the stirrup (37) is pretensionable into a coupled position and an open position, is provided on the stirrup.

10. Hoisting apparatus according to claim 2, characterised in that the connecting element (26) provided on the submersible pump unit (4) is provided with a traction relief means for the electric cable (5).

11. Hoisting apparatus according to claim 2, characterised in that the eye (2, 37) provided on the coupling part (1; 33) exhibits a lateral closable passage for the insertion of the electric cable (5).

12. Hoisting apparatus according to claim 1, characterised in that a tensioning element for mounting and simultaneously pretensioning the electric cable is provided in the region of the upper end of the shaft.

* * * * *